United States Patent [19]

Harris

[11] Patent Number: 4,730,698

[45] Date of Patent: Mar. 15, 1988

[54] FOLDABLE SAWHORSE

[76] Inventor: James E. Harris, 11912 SE. Powell Blvd., Portland, Oreg. 97266

[21] Appl. No.: 102,015

[22] Filed: Sep. 28, 1987

[51] Int. Cl.[4] ..... B27B 21/00

[52] U.S. Cl. ..... 182/153; 182/181; 182/225

[58] Field of Search ..... 182/153, 155, 181–186, 182/225

[56] References Cited

U.S. PATENT DOCUMENTS

| | | | |
|---|---|---|---|
| 249,508 | 11/1881 | Douns | 182/153 |
| 592,574 | 10/1897 | Ring | 182/153 |
| 1,656,558 | 1/1928 | Dysinger | 182/155 |
| 2,347,745 | 5/1944 | McKinney | 182/153 |
| 2,399,861 | 5/1946 | Evans | 182/153 |
| 2,874,004 | 2/1959 | Tucker | 182/226 |
| 2,882,021 | 4/1959 | Dreher | 182/153 |
| 3,734,235 | 5/1973 | Lanier | 182/153 |
| 4,238,001 | 12/1980 | Alexander | 182/153 |
| 4,565,263 | 1/1986 | Southworth | 182/184 |
| 4,681,187 | 7/1987 | Brown | 182/225 |

*Primary Examiner*—Reinaldo P. Machado
*Attorney, Agent, or Firm*—Robert L. Harrington

[57] ABSTRACT

A foldable sawhorse including a pair of end supports. Each end support having a bracket and a pair of legs. The legs being pivotally attached to the bracket for pivoting only between a downwardly, angularly extended work position and foldable outwardly around said bracket into a position with the legs extended over the bracket and in adjacent relationship. Brace members affix the legs together in the work position with one end releasable to permit inside out folding of the legs for storage.

6 Claims, 5 Drawing Figures

FOLDABLE SAWHORSE

FIELD OF THE INVENTION

This invention relates to a sawhose that is foldable for compact storage.

BACKGROUND OF THE INVENTION

Sawhorses have many uses, primarily as support for work pieces being sawn, nailed, drilled, etc., and even for standing on as may be required for various overhead projects, such as nailing, etc. Folding sawhorses have the desired benefit of being conveniently storable when not in use.

A user of a sawhorse is exposed to some danger in many of the work projects encountered and stability of the work piece support; i.e. the sawhorse, is important. Previously foldable sawhorses have had legs that fold as described in U.S. Pat. Nos. 249,508, 592,574, 1,656,558, 2,399,861, 3,734,235, 4,238,001, and 4,565,263. However, a characteristic of all of these sawhorses is that in the open or work position, the sawhorse is unstable. It is thus an object of the present invention to provide a sawhorse structure that is foldable for convenient storage but in the unfolded position is positively secured against inward pivoting and releasably fixed against outward pivoting to thereby provide a stable work station.

BRIEF SUMMARY OF THE INVENTION

The preferred embodiment of the present invention includes a pair of end supports adapted to cooperatively receive a spanning beam such as a two-by-four or the like. Each end support has a bracket (that attaches to the spanning beam) and a pair of support legs pivotally connected to the bracket. The pivotal connections are such that with the legs in the unfolded or work position, the legs engage the bracket and are positively prevented thereby from further inward folding. Outward folding of the legs is prevented by a cross brace between the legs. Folding for storage is effected by unfastening the cross brace and folding the legs outwardly and back over the bracket in an "inside-out" arrangement.

The invention will be more clearly understood by reference to the following detailed description and the drawings referred to therein. A brief description of the drawings.

Figure 1:
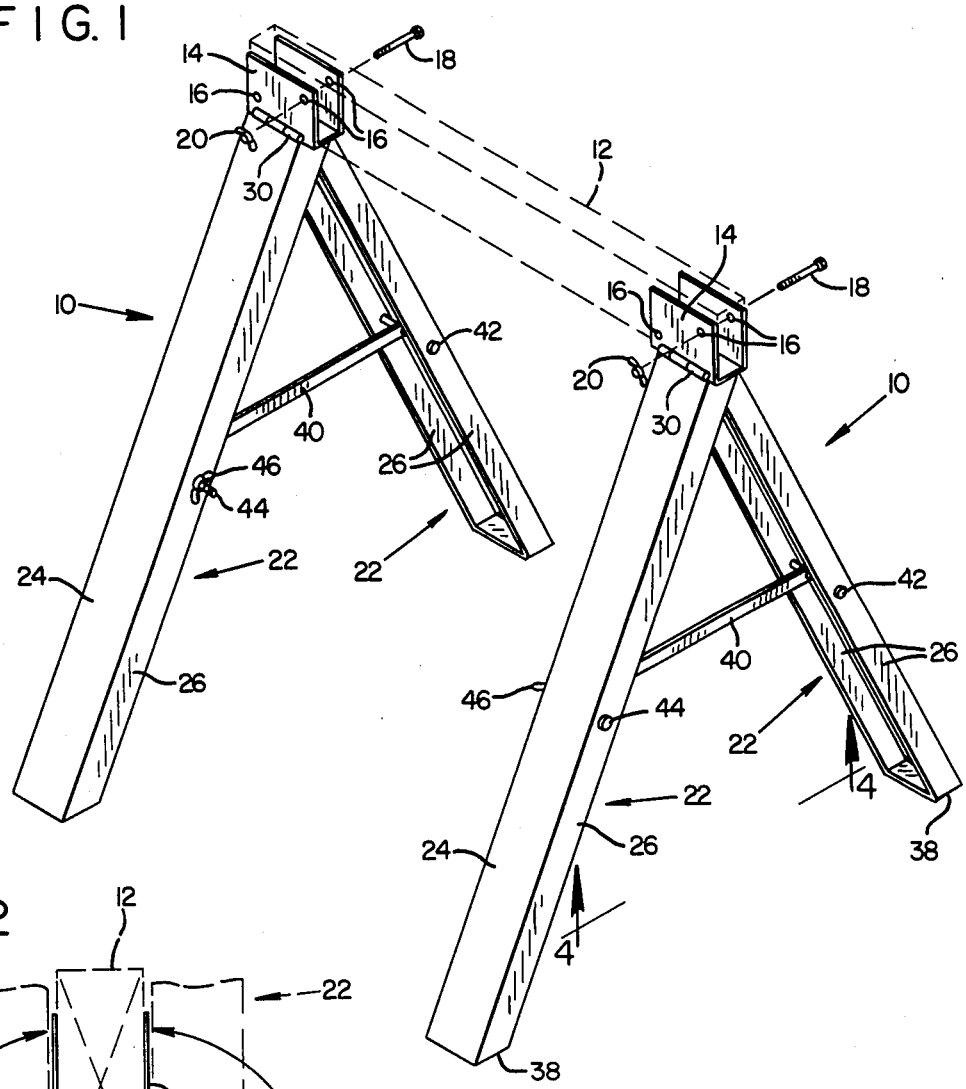
FIG. 1 is a perspective view of a pair of sawhorse end supports in accordance with the present invention, shown with a spanning beam in dash lines, and in the unfolded, usable or work position.

Referring to FIG. 1 of the drawings, a pair of f end supports 10 are illustrated in the work position. A spanning beam 12 is illustrated in dash lines and is fastened at each end to a bracket 14 of the end supports.

The spanning beam 12 may be a 2"×4" board of conventional length; e.g. 4 feet in length set on its narrow (2 inches) side into U-shaped portions of the brackets 14. Holes 16 through the legs of the U-shaped portion and corresponding holes drilled through the spanning beams, accommodate bolts 18. The bolts 18 fit through the aligned holes in the beam and U portions and are secured by wing nuts 20 to securely fasten the spanning beam to the end supports. Obviously, disassembly is accomplished merely by removing wing nuts 20 and withdrawing bolts 18.

The support legs 22 are channel-shaped with a base wall 24 and side walls 26. The legs 22 as well as the U-shaped bracket 14 are made of metal such as 18 gauge steel. The channel shape in addition to the metal material makes the legs very rigid.

Figure 2:
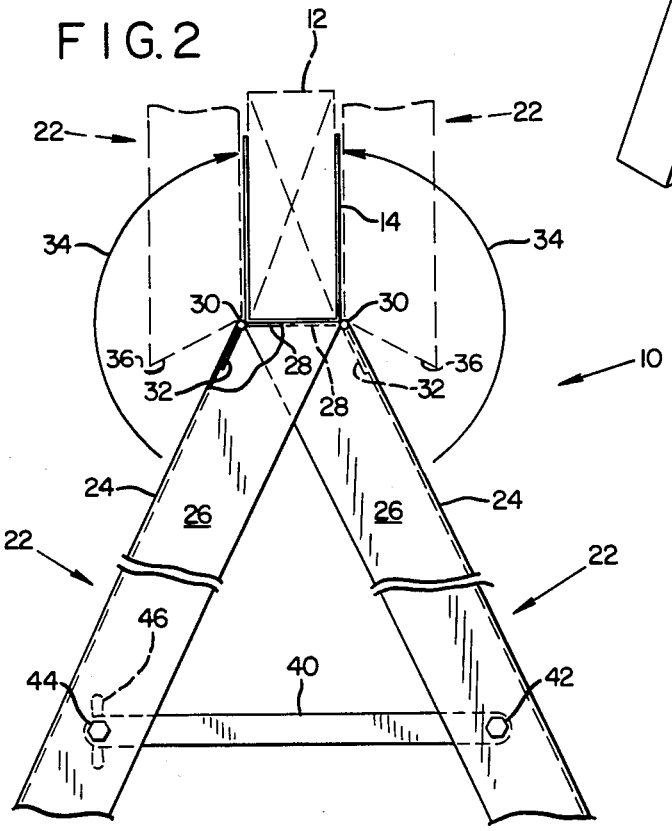
FIG. 2 is an end view of one of the sawhorse end supports illustrated in FIG. 1.
Figure 3:
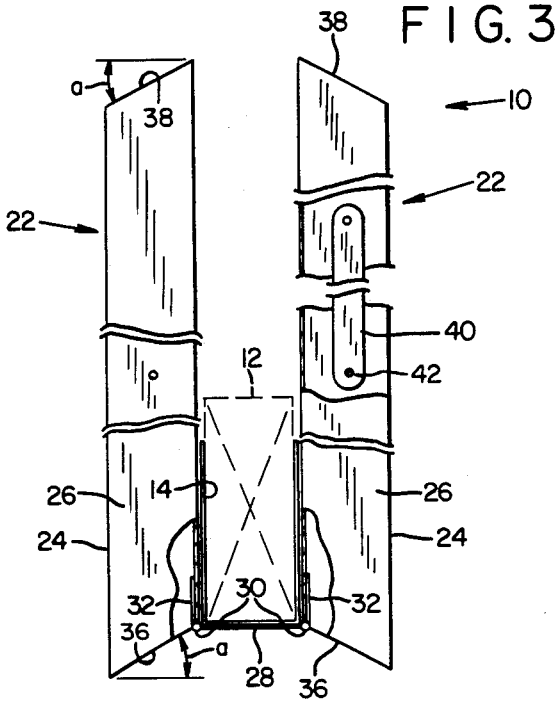
FIG. 3 is an end view of the end support of FIG. 2 shown in its folded position.
Figure 4:
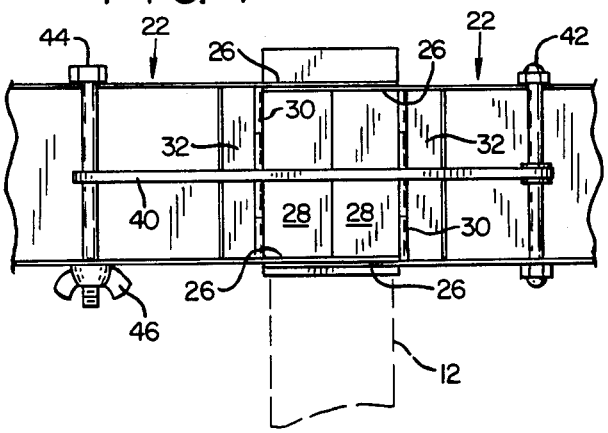
FIG. 4 is a view taken on view lines 4—4 of FIG. 1.

The U portion of the bracket 14 has straight sides and a flat bottom, forming sharp (90 degrees) corners. As best seen in FIGS. 2, 3 and 4, conventional butt hinges are attached to the corners of the bracket. As noted, the butt hinges have two flat metal plates 28, 32 that are pivotally connected by a pin inserted through aligned sleeve-like edge sections; e.g. in the manner of a door hinge, and forming a pivot 30.

The plate 28 of each hinge is spot welded to the flat bottom of the U bracket so that the pivot 30 of the hinge is just outside the flat side of the bracket (see FIG. 2). The two plates 28 of the two opposed hinges are assembled in edge-to-edge adjacency on the bottom of the U bracket, the plates 28 being of a length of avoid overlapping. Plate 32 of the hinges are spot welded to the inside of base wall 24 of the legs 22 (FIGS. 2 and 3). It will be understood that such arrangement allows pivoting of the legs 22, indicated by arrows 34, between an unfolded position (solid line of FIG. 2) and a folded position (dash lines of FIG. 2 and the solid line position of FIG. 3).

As will be particularly noted from FIG. 3, the inner end 36 and outer end 38 of the legs 22 are angle cut (side walls 26 are cut at a bias relative to the base wall 24). This angle is preferably about 26 degrees from a line perpendicular to the base wall 24; i.e. angle alpha in FIG. 3. It is important that the two angle cuts on the inner end 36 of each of the legs 22 pivots into abutment with the underside of the bottom wall of bracket 14 at the desired work position. Interference as between the side walls 26 of opposed legs is prevented by the attachment of the hinges to the legs being offset one from the other by at least the thickness of the walls 26. The side walls 26 of opposed support legs 22 thus slide past one another in overlapping relation as particularly seen from FIG. 4.

With the inner ends 36 of legs 22 abutting the underside of brackets 14, the outer ends 38 lie flat on a supporting surface. The two legs projected from the bracket at oppositely directed 26 degree angles forms a combined angle of about 52 degrees between the legs.

In order to secure the legs 22 at the full open or unfolded position, cross braces 40 are precisely fit to span the legs. Headed pins 42, 44 inserted through the aligned holes in the cross brace ends and channel walls 26 secure the cross braces 40 to the legs. One end of the braces 40 is secured by pin 42 in a manner that permits pivoting of the brace about pin connection 42 while the other end is releasably pinned, i.e. wing nuts 46 can be readily unscrewed and pins 44 withdrawn to release that end of braces 40.

Using the sawhorse requires that the end supports 10 are open, and cross braces 40 are pinned at each end to the legs 22. A 2"×4" board is inserted into the U brackets and bolted with bolts 18 to a pair of the end supports 10. In this position the leg ends 36 are abutted against the underside of the U brackets and ends 38 are flush on the support surface. This above structure makes up a single sawhorse. As it is often desirable to use a pair of sawhorses, the above structure may simply be duplicated.

When a project is completed, storage of the sawhorse may be effected in one of two ways. The 2"×4" cross beam may be left attached to the brackets. Wing nut 46 is unscrewed from pin 44 at each end support and pin 44 withdrawn to release cross brace 40 from that leg. Brace 40 is then pivoted into the channel of the other leg and both legs pivoted out and up over the bracket 14 as illustrated in FIG. 3.

Alternately, bolts 18 may be withdrawn to allow removal of the 2"×4" spanning beam 12. In either case (the unified sawhorse folded into a unitary narrow package or the three pieces stored separately) the sawhorse components are readily stored in a small space. Most importantly, when assembled into the work condition, a solid stable sawhorse is provided.

Figure 5:
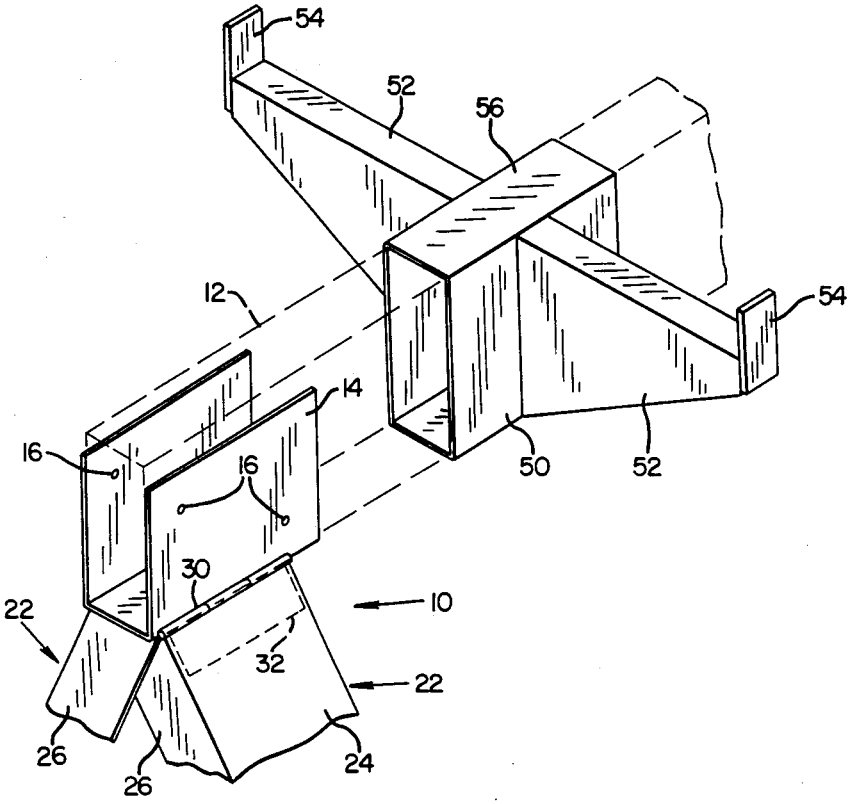
FIG. 5 is a perspective view of an accessory item for the sawhorse structure of FIG. 1.

FIG. 5 is an accessory item for the sawhorse of the invention referred to as a plank support member. A square-shaped tubular base 50 is provided with securely attached wing members 52 (e.g. by welding) that extend flush out from the top edge 56 of the base 50. End tabs 54 are set apart equidistant from base 50 to capture the width of a plank; e.g. a plank 12 inches wide. A plank support member is fit over the 2"×4" beam at each end, just inside the end support 10. A 12-inch plank can then be laid lengthwise on the sawhorse to provide secure footing for a worker to stand on. Such support would normally require two sawhorses with the board laid across the two spanning beams.

The above is a preferred embodiment and others skilled in the art will conceive of variations and modifications without departing from the inventive concent defined in the accompanying claims.

I claim:

1. A foldable sawhorse comprising; a pair of end supports, each end support having a bracket and a pair of support legs projected downwardly and outwardly from said bracket in a work position, pivotal connecting means pivotally connecting each leg support to the bracket to permit outward pivoting of the legs, a cross brace extended between the legs and fastened to both legs, and removably fastened to one of the legs, said cross brace preventing outward pivoting of the legs in the work position, and stop means positively preventing pivoting of the legs inwardly from said work position, said cross brace being releasable from said one of the legs for pivoting of the legs back and over the bracket to bring the legs substantially together in parallel relationship in an upwardly projected compact position for storage.

2. A foldable sawhorse as defined in claim 1 including a spanning beam extended between the brackets of the pair of end supports and releasably fastened thereto.

3. A foldable sawhorse as defined in claim 2 wherein the brackets are U shaped and the spanning beam is correspondingly shaped in cross section to fit the U shape of the bracket.

4. A foldable sawhorse as defined in claim 3 wherein the U shaped bracket defines corners at the intersection of flat sides and bottom, and butt hinges having side plates pivotally joined and forming a pivot, said plates attached to the leg supports and bracket with the pivot positioned at the outside corners of the bracket.

5. A foldable sawhorse as defined in claim 4 wherein the legs are channel shaped with base wall and side walls, the base wall secured to a hinge plate and the side walls extended under the bracket in the work position, said side walls angle cut to abut against the straight bottom side of the bracket with the legs positioned at a desired angularly directed work position.

6. A sawhorse as defined in claim 3 including a pair of plank supports, each support having a base member defining a sleeve opening to fit over the spanning beam, said base member having wing portions secured and extended laterally from said base member, holding tabs on the wing portions equidistant from the base member and spaced apart the width of a plank, the pair of plank supports mounted to the spanning beam in spaced apart relationship and cooperatively supporting a plank on the sawhorse for support of a worker.

* * * * *